United States Patent [19]

McCloskey

[11] Patent Number: 4,661,012

[45] Date of Patent: Apr. 28, 1987

[54] SOIL RETAINING APPARATUS AND BLOCKS THEREFOR

[75] Inventor: Antone J. McCloskey, Longwood, Fla.

[73] Assignee: Gator Culvert Company, Lantana, Fla.

[21] Appl. No.: 757,374

[22] Filed: Jul. 22, 1985

[51] Int. Cl.[4] ..... E02B 3/12

[52] U.S. Cl. ..... 405/16; 52/588; 52/609

[58] Field of Search ..... 405/16, 17, 19, 20; 52/588, 604, 608, 609, 611; 404/41

[56] References Cited

U.S. PATENT DOCUMENTS

| | | | |
|---|---|---|---|
| 1,164,707 | 12/1915 | Edinger | 405/20 |
| 4,372,705 | 2/1983 | Atkinson | 405/19 |
| 4,438,614 | 3/1984 | Raith et al. | 52/588 X |

FOREIGN PATENT DOCUMENTS 1265140 5/1961 France .

OTHER PUBLICATIONS

"Armorloc, Class 44"—Nicolon Corp. Brochure.

*Primary Examiner*—David H. Corbin

*Attorney, Agent, or Firm*—Pettis & McDonald

[57] ABSTRACT

Erosion control and soil retaining apparatus is disclosed and constitutes a block having a pair of first arms extending generally opposite one another and generally parallel to the first axis and a pair of second arms extending generally parallel to the second axis that is normal to the first axis, with those second arms forming a socket therebetween. An extended soil retention apparatus may be formed by interlocking assembly of a plurality of such blocks.

17 Claims, 4 Drawing Figures

SOIL RETAINING APPARATUS AND BLOCKS THEREFOR

FIELD OF THE INVENTION

This invention relates generally to blocks used for the prevention of erosion and for retention of soil and is especially suited for use on river banks and beds and on other embankments and on beaches. The invention is also related to a structure formed of an interlocking collection of such blocks that provides for articulated movement of adjacent blocks to facilitate conforming of the structure to the underlying terrain.

BACKGROUND OF THE INVENTION

Various types of revetment structures have long been used to prevent soil erosion, particularly on inclined surfaces and surfaces that engage flowing water. These structures have ranged from simple use of riprap or chunks of scrap concrete to elaborate, custom-designed structures.

Among the various popular types of erosion control apparatus have been mats formed of a number of adjoining or interlocking blocks, made of a material such as concrete. These blocks conventionally have either nested adjacent one another or have utilized some means of connecting adjacent blocks to form a large structure. In most of these structures various types of special connecting devices have been used to join the separate blocks into a mat. Such connecting devices have included cables or pins extending through adjacent blocks or the use of special connector blocks that engage and join adjacent revetment blocks. However, with the exception of a few structures, such as those disclosed in U.S. Pat. No. 1,164,707 and French Patent No. 1,265,140, few prior structures have utilized blocks configured such that the blocks themselves engage one another to form. The requirement for additional connecting apparatus adds additional complication to both the manufacture and the installation of such soil control apparatus.

SUMMARY OF THE INVENTION

It is an object of the present invention to provide apparatus for use in erosion control and soil retention that is relatively economical and simple to install. It is a further object of this invention to provide such apparatus which is comprised of a plurality of interlocking blocks. It is yet another object of this invention to provide such an apparatus in which the configuration of the blocks themselves provides for the interlocking engagement between one another.

To achieve these and other objectives that will become apparent to those skilled in the art, this invention provides for blocks for use in soil retaining apparatus, each of which blocks has a first surface, a second surface spaced from the first surface, side surfaces extending between the first and second surfaces and a plane of symmetry intersecting both the first surface and the second surface. On each side of the plane of symmetry is a first arm defined by a portions of the first, second and side surfaces and extending away from the plane of symmetry and adjacent a first end of the block and a second arm defined by portions of the first, second and side surfaces and extending longitudinally parallel to and spaced from the plane of symmetry. The second arm is positioned adjacent the second end of the block generally opposite the first end, the two second arms of the block defining a socket therebetween, the socket being narrowed adjacent the longitudinally the outermost extremities of the two second arms. The first arms and the socket are configured such that the socket of the block may receive therewithin in a locking manner one of the first arms from each of two other blocks that are positioned with the adjacent first ends of the two other blocks in mutually abutting relationship. By the inclusion of a plurality of such blocks with the first arms of mutually adjacent pairs of blocks being received into the socket of another block, a plurality of such blocks may be formed into an interlocking relationship to create a soil retaining mat. In a preferred embodiment of this invention the side surfaces are sloped inwardly of the block between the first and second surfaces to provide for articulation of adjacent blocks, such as when placed upon an irregular surface.

BRIEF DESCRIPTION OF THE DRAWINGS

Preferred embodiments of this invention will be described in greater detail below in which.

DETAILED DESCRIPTION OF A PREFERRED EMBODIMENT

Figure 1:
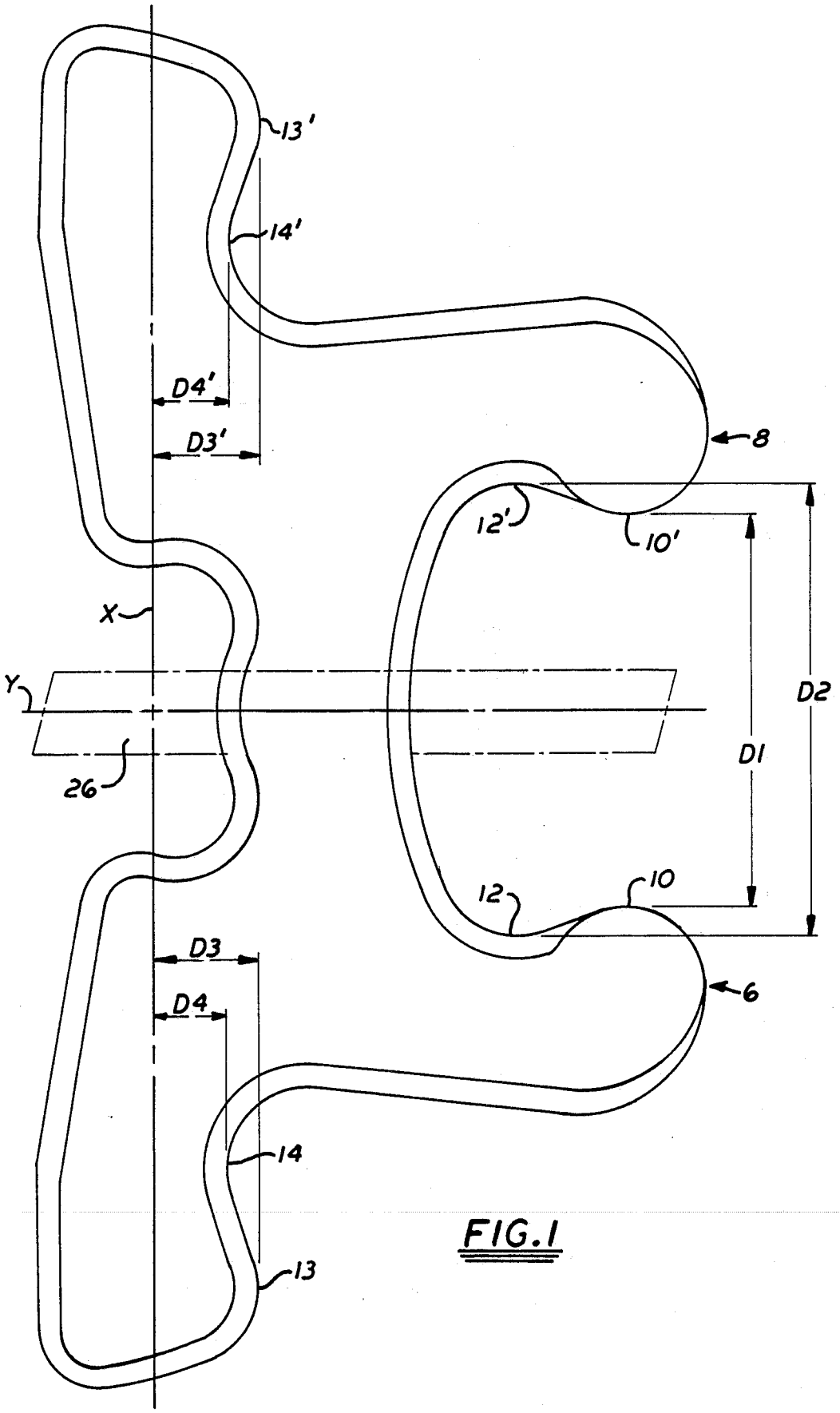
FIG. 1 illustrates a plan view of a particular preferred configuration of such a block.
Figure 2:
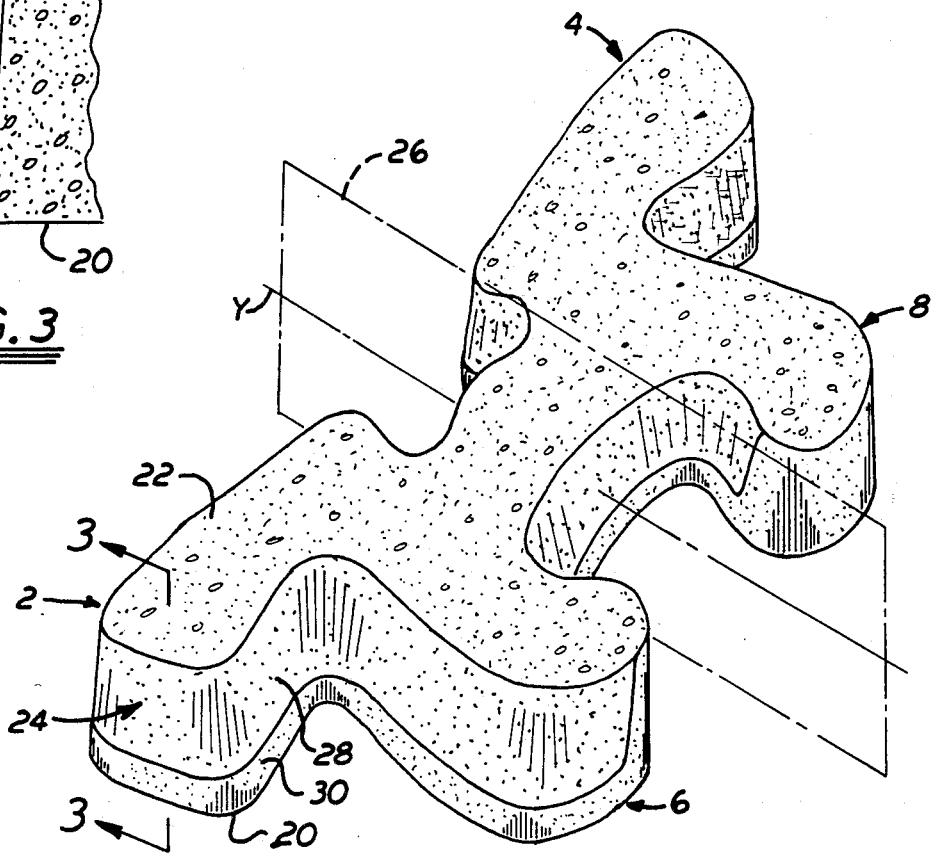
FIG. 2 is a perspective view of the block of FIG. 1.

A preferred embodiment of the block of this invention is illustrated in the plan view of FIG. 1 and the perspective view of FIG. 2. This block is formed of a material having a density substantially greater than that of water, which material may preferably be concrete.

As illustrated most clearly in FIG. 1, the configuration of the block may be understood with respect to the two axes illustrated and designated by the letter designator x and y. A pair of first arms 2 and 4 extend generally opposite one another and generally parallel to a first axis, illustrated in FIG. 1 as the axis x. A pair of second arms, generally indicated by the reference numbers 6 and 8, extend generally parallel to a second axis y, which is normal to the first axis x and intermediate the oppositely extending first arms 2 and 4. These second arms 6 and 8 extend or project in a direction away from the first axis x and are spaced from one another, such as is shown in FIG. 1, on opposite sides of the axis y.

These second arms 6 and 8 are configured to form a socket therebetween. This is accomplished by configuring the second arms 6 and 8 such that the distance D1, measured normal to the second axis y, between mutually facing portions of the second arms 6 and 8 taken at points 10 and 10' proximal the outermost portion of those second arms is less than the distance D2, measured in a similar manner, and taken at points 12 and 12', which points 12 and 12' are intermediate the first axis x and the first points 10 and 10'. This configuration provides a generally c-shaped socket whose mouth is narrower than the interior portions to provide for a locking engagement of members inserted therewithin, in a manner to be described below.

As illustrated most clearly in FIG. 1, each of the first arms 2 and 4 is configured to have a larger outer portion and smaller inner portion. This relationship is illustrated by the relative distances D3 and D4 measured normal to the first axis x. Distances D3 and and D3' is measured normal to the first axis x and between the first axis x and respective first points 13 and 13' on the arms 2 and 4 that are generally proximal the outermost portions of those respective arms 2 and 4. Likewise, distances D4 and D4' are measured normal to axis x and between that axis and respective seconds points 14 and 14' that are intermediate the respective first points 12 and 12' and the second axis y. The interrelationship of the configuration of the first arms and the second arms and socket defined therebetween will be explained in greater detail below.

The configuration of the block of this invention may further be understood from the perspective view of FIG. 2. As illustrated in greater detail in this figure, the block includes the first surface 20, which may suitably be the lower surface of the block in FIG. 2. Likewise it includes a second surface 22 spaced from that first surface, with second surface may suitably be the upper surface of the block. Extending between the first and second surfaces 20 and 22 are side surfaces 24. These side surfaces 24 are substantially continuous around the edge of the block.

Intersecting both the first surface 20 and second surface 22 is a plane of symmetry, indicated in phantom on FIG. 2 by the reference numeral 26. The block is substantially symmetrical on both sides of this plane 26. On each side of the plane 26 extend the first arms 2 and 4, which are defined by and include portions of the first, second and side surfaces 20, 22 and 24. The end of the block to which both of these first arms are adjacent is defined as the first end of the block. Second arms 6 and 8 are also defined by other portions of the first, second and side surfaces 20 22, and 24. Because plane 26 preferably includes within it the axis y illustrated in FIG. 1, the second arms 6 and 8 extend longitudinally generally parallel to and spaced from this plane 26. These arms 6 and 8 are positioned adjacent a second end of the block generally opposite the first end, with a portion of the arms in this preferred embodiment actually defining that second end. These two arms define a socket between them, which is narrowed adjacent the longitudinally outermost extremity of the arms.

To facilitate articulation of adjacent blocks in a manner to be described below, at least a portion 28 of the side surfaces 24 of each of the blocks slopes inwardly of the blocks between the first surface 20 and the second surface 22. The taper on the block effected by the inward slope, as shown on FIG. 3, may suitably be in the range of about 6 percent to 7 percent.

Figure 3:
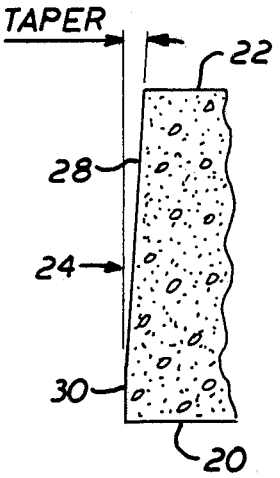
FIG. 3 is a fragmentary sectional view taken along line 3—3 of FIG. 2 to illustrate the sloping side surface of block of FIG. 2.

As shown in FIGS. 2 and 3, the side surface 24 includes not only the sloped or tapered portion 28 extending from the second surface 22 toward the first surface 20, but also includes a first portion 30 that is generally normal to the first surface 20 and extends between that first surface 20 and the sloping portion 28 of the side surface. Suitably the first portion 30 of the side surface 24 may extend about three-quarters of an inch from the first surface 20 up to the sloping second portion 28 of the side surface 24. The sloping or tapered second portion 28 of the side surface 24 may suitably extend approximately $3\frac{1}{2}$ inches from the first portion 30 to the second surface 22, such that the overall thickness of the block may preferably be approximately $4\frac{1}{4}$ inches. The block preferably may extend approximately $8\frac{1}{2}$ inches from the first end defined by the first arms, to the second end defined by the outermost extremities of the second arms. Additionally, the block may suitably be approximately 17 inches wide between the outermost extremities of the two opposing first arms 2 and 4. With the taper of the side surface second portion 28, it may be seen that the configuration of both the first surface 20 and the second surface 22 of the block are substantially similar. The second surface 22 is substantially centered above the first surface 20 and, as a result of the taper, has an area less than the area of the first surface 20.

Figure 4:
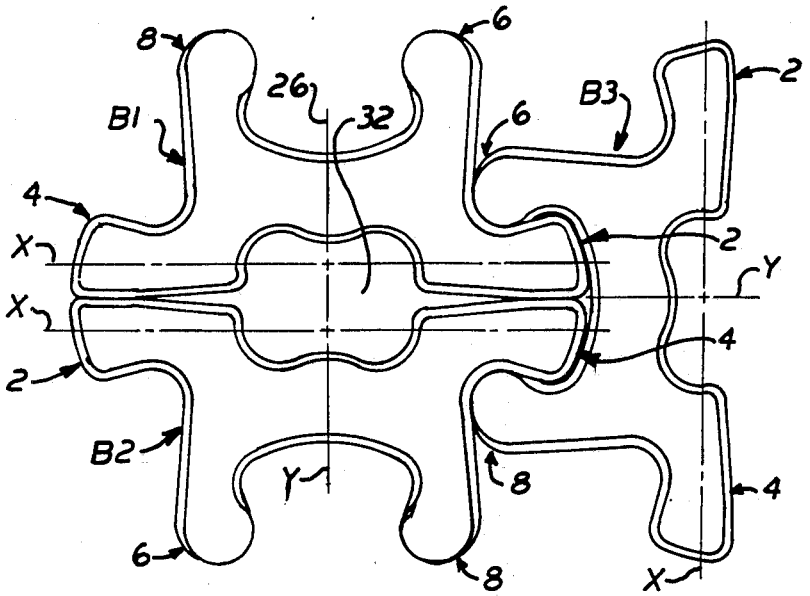
FIG. 4 illustrates the interlocking relationship of a plurality of adjacent blocks such as illustrated in FIGS. 1 and 2.

FIG. 4 illustrates the interlocking assembly that may be accomplished with the blocks of this invention to provide an extended mat for soil retention. In FIG. 4 a pair of substantially identical blocks B1 and B2 according to this invention are positioned with their respective first ends abutting one another and their respective planes of symmetry 26, only the edge of which is visible in FIG. 4, coplanar, with their second axes Y likewise collinear. The shape thus defined by each mutually abutting pair of first arms 2 and 4 is substantially similar in configuration and size to the space between the pair of second arms 6 and 8 on such a block. Thus, as shown in FIG. 4 the mutually abutting first arms 2 and 4 of two such blocks B1 and B2 are interlockingly received within the generally C-shaped socket defined by the space between the pair of second arms 8 on a third such block indicated by the designator B3. The taper on the blocks provided by the slope on the side surfaces 28 of each of the blocks provides for articulation between adjacent such blocks and facilitates conformation of the interlocking assembly over uneven support surfaces, such as river bed or banks or the like.

As is obvious, the mat formed by the interlocking engagement of mutually adjacent such blocks may be extended to any desired length and width by simple repetition of the pattern of assembly illustrated in FIG. 4. The blocks are configured, as shown on FIG. 4, to provide for various openings and voids, such as the void 32, through such a mat to provide for the deposition of soil into such voids and the growth of vegetation therethrough to further assist in anchoring a mat to the soil surface to be protected. It may also be noted that the self-interlocking arrangement of the blocks and their provision for articulation facilitates preassembly of portions of such mats, such as at the factory where the blocks are made, so that preassembled mat portions may be transported to a job sight and then lifted and carried into place using the known technique of a sling and spreader bar, such that the preassembled sections may be formed into a complete mat more quickly.

While the foregoing discloses a particular preferred embodiment of the apparatus of this invention it is to be recognized that numerous variations and modifications, all within the scope of the present invention, will readily occur to those skilled in the art. All of such variations and modifications within the scope of the present invention are intended to be incorporated herewithin, the invention being limited solely by the claims appended hereto.

What is claimed is:

1. A block for use in soil retaining apparatus, said block comprising a pair of first arms extending generally opposite one another and generally parallel to a first axis extending through said first arms;

a pair of second arms extending generally parallel to a second axis, said second axis being normal to said first axis and intermediate said oppositely extending first arms, said second arms extending away from said first axis and being spaced from one another and configured such that a first distance, measured normal to said second axis, between the mutually facing portions of said pair of second arms taken at first point on said arms proximal the outermost portion thereof is less than a second distance so measured and taken at second points intermediate said first points and said first axis;

each of said first arms being configured such that the portion thereof extending away from said first axis in the direction towards said second arms extends farther from said first axis at a first point on said arm proximal the outermost portion thereof than at a second point intermediate said first point and said second axis and the width of each said first arm measured normal to said first axis and parallel to said second axis at said first point on said first arm is greater than half of said first distance measured between said second arms.

2. The block of claim 1 further comprising a first surface extending generally parallel to the plane defined by said first and second axes, a second surface spaced from said first surface, and side surfaces extending between said first surface and said second surface.

3. The block of claim 2 wherein the configuration of said first surface is substantially similar to the configuration of said second surface.

4. The block of claim 3 wherein said second surface is substantially centered above said first surface, and wherein the area of said second surface is less than the area of said first surface, and wherein at least a portion of said side surfaces slopes inwardly of said block between said first surface and said second surface.

5. The block of claim 1 wherein said first arm pair is positioned adjacent a first end of said block.

6. The block of claim 5 wherein said block is substantially symmetrical on opposite sides of a plane of symmetry, which plane of symmetry contains said second axis and is normal to said first axis.

7. The block of claim 6 wherein said first arms are configured such that, when two such blocks are positioned with their respective first ends abutting one another and their respective said planes of symmetry coplanar and said second axes collinear, the shape defined by each mutually abutting pair of said first arms is substantially similar in configuration and size to the space between said pair of second arms on such a block, whereby such a pair of mutually abutting first arms of two such blocks may be interlockingly received within the space between the pair of second arms of a third such block.

8. The block of claim 5 wherein said pair of second arms defines a socket for receiving in a locking and articulating manner one of said first arms each from two other said blocks that are positioned with the respective said first ends of said two other blocks in mutually abutting relationship with their respective said first axes generally parallel to one another and their respective second axes substantially parallel to one another.

9. The block of claim 8 wherein said socket is generally in the shape of the letter C.

10. A block for use in soil retaining apparatus, said block comprising a first surface;

a second surface spaced from said first surface;

side surfaces extending between said first and second surfaces; and a plane of symmetry intersecting both said first surface and said second surface and having on each side thereof a first arm defined by portions of said first, second and side surfaces and extending away from said plane of symmetry and being adjacent a first end of said block, each said first arm having a first portion spaced from said plane of symmetry and having a predetermined width measured parallel to said plane of symmetry and a second portion intermediate said first portion and said plane of symmetry having a smaller width measured parallel to said plane of symmetry;

a second arm defined by portions of said first, second and side surfaces and extending longitudinally generally parallel to and spaced from said plane of symmetry and being positioned adjacent a second end of said block generally opposite said first end;

the two said second arms defining a socket therebetween, said socket having a narrowed portion adjacent the longitudinally outermost extremities of said two second arms such that the width of said socket narrowed portion measured normal to said plane of symmetry is less than twice said width of said first arm first portion; and said first arms and said socket being configured such that said socket of said block may receive therewithin in a locking manner one of said first arms from each of two other said blocks that are positioned with the respective said first ends of said two other blocks in mutually abutting relationship.

11. A block according to claim 10 wherein at least a portion of said side surfaces slopes inwardly of said block between said first surface and said first surface.

12. A block according to claim 10 wherein said side surfaces comprise a first portion adjoining and generally normal to said first surface and a second portion extending between said side surface first portion and said second surface and sloping inwardly of the block between said side surface first portion and said second surface.

13. A block according to claim 10 wherein said socket includes an open portion facing generally parallel to said plane of symmetry.

14. Soil retaining apparatus comprising a plurality of at least three interlocked blocks, each said block having a first surface;

a second surface spaced from said first surface;

side surfaces extending between said first and second surfaces;

a plane of symmetry intersecting both said first surfaces and said second surfaces and having on each side thereof a first arm defined by portions of said first, second and side surfaces and extending away from said plane of symmetry and being adjacent a first end of said block, each said first arm having a first portion spaced from said plane of symmetry and having a predetermined width measured parallel to said plane of symmetry and a second portion intermediate said first portion and said plane of symmetry having a smaller width measured parallel to said plane of symmetry;

a second arm defined by portions of said first, second and side surfaces and extending longitudinally generally parallel to and spaced from said plane of symmetry and being positioned adjacent a second end of said block generally opposite said first end;

the two said second arms defining a socket therebetween, said socket having a narrowed portion adjacent the longitudinally outermost extremities of said two second arms such that the width of said socket narrowed portion measured normal to said plane of symmetry is less than twice said width of said first arm first portion; and said first arms and said socket being configured such that said socket of said block may receive therewithin in a locking manner one of said first arms from each of two other said blocks that are positioned with the respective said first ends of said two other blocks in mutually abutting relationship.

15. Soil retaining apparatus according to claim 14 wherein at least a portion of said side surfaces slopes inwardly of each of said blocks between the respective said first surface and said second surface of each said block.

16. Soil retaining apparatus according to claim 14 wherein said socket on each said block includes an open portion facing generally parallel to said plane of symmetry for said block.

17. Soil retaining apparatus according to claim 16 wherein each said socket is generally in the form of the shape of the letter C.

* * * * *